US011245972B2

(12) United States Patent
Hill

(10) Patent No.: US 11,245,972 B2
(45) Date of Patent: Feb. 8, 2022

(54) EAR TIP DEVICE

(71) Applicant: Steven Hill, Hutto, TX (US)

(72) Inventor: Steven Hill, Hutto, TX (US)

( * ) Notice: Subject to any disclaimer, the term of this patent is extended or adjusted under 35 U.S.C. 154(b) by 106 days.

(21) Appl. No.: 16/705,744

(22) Filed: Dec. 6, 2019

(65) Prior Publication Data

US 2021/0176553 A1 Jun. 10, 2021

(51) Int. Cl.
*H04R 1/10* (2006.01)

(52) U.S. Cl.
CPC ..... *H04R 1/1016* (2013.01); *H04R 2460/11* (2013.01)

(58) Field of Classification Search
CPC ..... A61F 11/08
See application file for complete search history.

(56) References Cited

U.S. PATENT DOCUMENTS 4,724,922 A * 2/1988 Kalayjian ..... H04R 25/652 181/135
7,889,881 B2 * 2/2011 Ostrowski ..... H04R 1/1016 381/329
8,201,561 B2 6/2012 Blanchard
8,413,331 B2 4/2013 Tiemens
8,758,436 B2 * 6/2014 Clayton ..... A61F 2/18 623/10
D794,612 S 8/2017 Katopis
2005/0135650 A1 * 6/2005 Berger ..... A61F 11/08 381/382
2007/0036383 A1 2/2007 Romero
2015/0382093 A1 12/2015 Jones
2018/0263822 A1 * 9/2018 Rappaport ..... A61F 11/08
2018/0288520 A1 10/2018 Roberts

OTHER PUBLICATIONS

Ryanjsoo, MandarinEs Symbio W Silicone+Foam Special Hybrid Universal Ear Tips, Oct. 23, 2017, pp. 1-6 (Year: 2017).*
Symbio, SYMBIO W Memory Foam & Silicone Universal Premium Ear Tips, Nov. 13, 2020, pp. 1-4 (Year: 2020).*

* cited by examiner

*Primary Examiner* — Angelica M McKinney

(57) ABSTRACT

An ear tip device for padding an in-ear headphone includes a cylinder, which comprises silicone and viscoelastic polyurethane foam so that the cylinder is resiliently compressible. A channel is axially positioned in and extends through the cylinder. The channel is configured to expand to allow insertion of a headphone and to contract to couple the cylinder to the headphone. The cylinder is configured to be compressed between digits of a hand of a user, positioning the user to at least partially insert the cylinder into an ear canal of the user. The cylinder is positioned to expand to conform to the ear canal and to couple the cylinder to the ear. The cylinder is configured to attenuate ambient noise and to direct a sound transmitted by the headphone to an eardrum of the user.

3 Claims, 3 Drawing Sheets

EAR TIP DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to ear tip devices and more particularly pertains to a new ear tip device for padding an in-ear headphone.

(2) Description of Related Art Including Information Disclosed Under 37 CFR 1.97 and 1.98

The prior art relates to ear tip devices. Prior art ear tip devices may comprise pads having a variety of generally conical shapes.

BRIEF SUMMARY OF THE INVENTION

An embodiment of the disclosure meets the needs presented above by generally comprising a cylinder, which comprises silicone and viscoelastic polyurethane foam so that the cylinder is resiliently compressible. A channel is axially positioned in and extends through the cylinder. The channel is configured to expand to allow insertion of a headphone and to contract to couple the cylinder to the headphone. The cylinder is configured to be compressed between digits of a hand of a user, positioning the user to at least partially insert the cylinder into an ear canal of the user. The cylinder is positioned to expand to conform to the ear canal. The cylinder is configured to attenuate ambient noise and to direct a sound transmitted by the headphone to an eardrum of the user.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
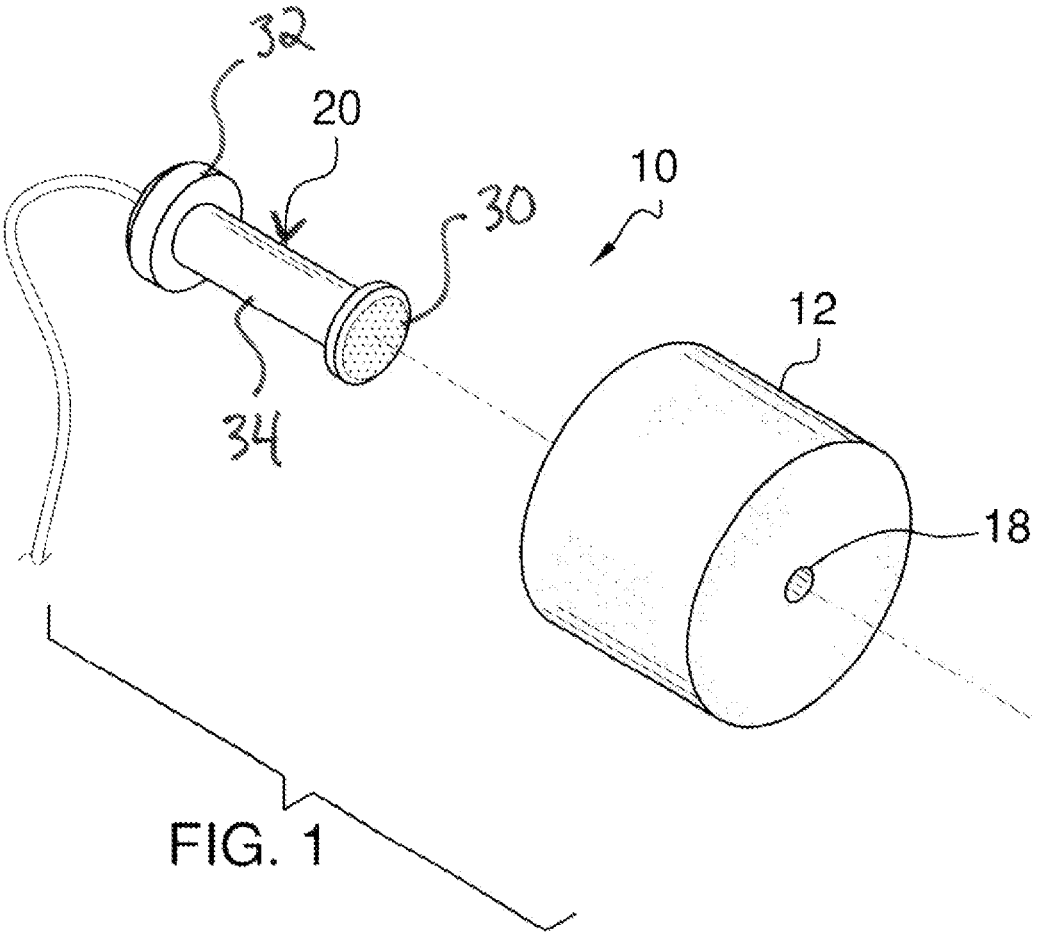
FIG. 1 is an exploded view of an ear tip device according to an embodiment of the disclosure.
Figure 2:
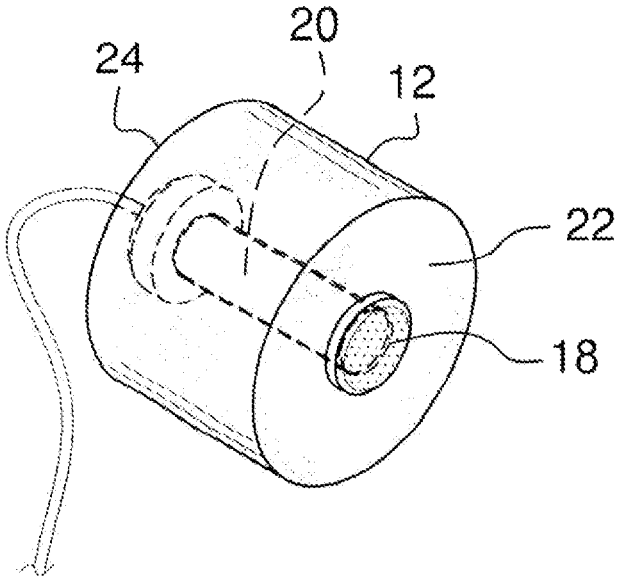
FIG. 2 is an isometric perspective view of an embodiment of the disclosure.
Figure 3:
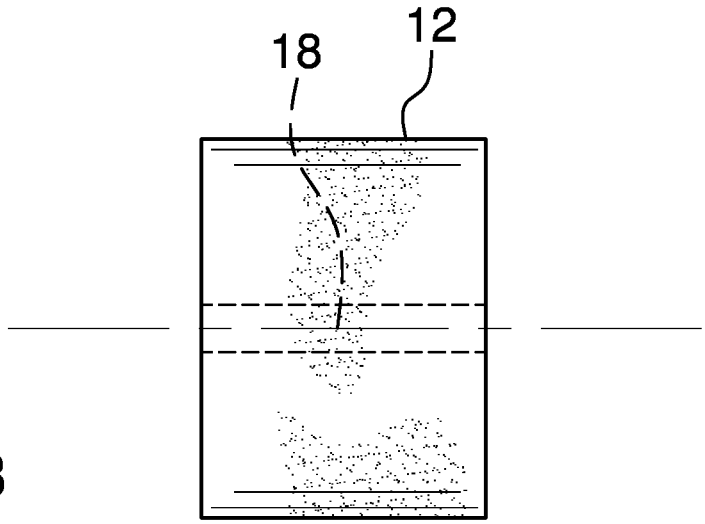
FIG. 3 is a side view of an embodiment of the disclosure.

With reference now to the drawings, and in particular to FIGS. 1 through 5 thereof, a new headphone and ear tip device embodying the principles and concepts of an embodiment of the disclosure and generally designated by the reference numeral 10 will be described.

As best illustrated in FIGS. 1 through 5, the ear tip device 10 generally comprises a headphone 20 having a speaker 30, a base 32, and a medial portion 34 extending between the speaker 30 and the base 32. The medial portion 34 is cylindrical and the base 32 is disc-shaped and concentric with the medial portion 34. The base 32 has a radius greater than a radius of the medial portion 34. A cylinder 12, which comprises silicone and viscoelastic polyurethane foam so that the cylinder 12 is resiliently compressible. The cylinder 12 may comprise a shell 14 and a core 16. The shell 14 defines an interior space 26 that is substantially occupied by the core 16. The core 16 comprises viscoelastic polyurethane foam and the shell 14 comprises silicone. The present invention also anticipates the cylinder 12 comprising a substantially uniform mixture, blend, or composite of silicone and viscoelastic polyurethane foam.

A channel 18 is axially positioned in and extends through the cylinder 12. The channel 18 is configured to expand to allow insertion of the headphone 20 and to contract to couple the cylinder 12 to the headphone 20. The cylinder 12 is configured to be compressed between digits of a hand of a user, positioning the user to at least partially insert the cylinder 12 into an ear canal of the user. The cylinder 12 is positioned to expand to conform to the ear canal and to couple the cylinder to the ear so that the cylinder 12 is configured to attenuate ambient noise and to direct a sound transmitted by the headphone 20 to an eardrum of the user.

As a leading end 22 of the cylinder 12, that which is inserted into the ear canal, is circumferentially equivalent to a trailing end 24 of the cylinder 12, compression of the cylinder 12 proximate to the leading end 22 is required for the user to at least partially insert the cylinder 12 into the ear canal. An advantage of the device 10 over prior art devices having a generally conical shape is that a larger volume of material is inserted into the ear canal, thus providing for enhanced coupling of the device to the ear within the ear canal and for increased attenuation of ambient noise.

Figure 4:
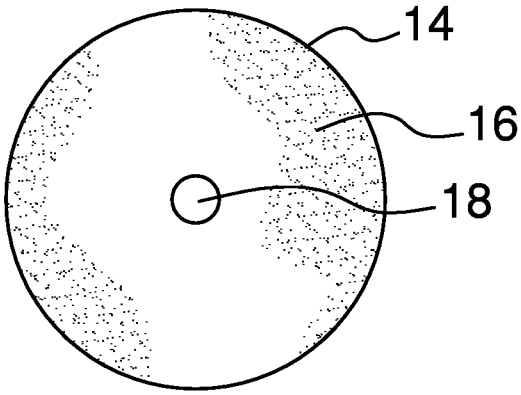
FIG. 4 is an end view of an embodiment of the disclosure.
Figure 5:
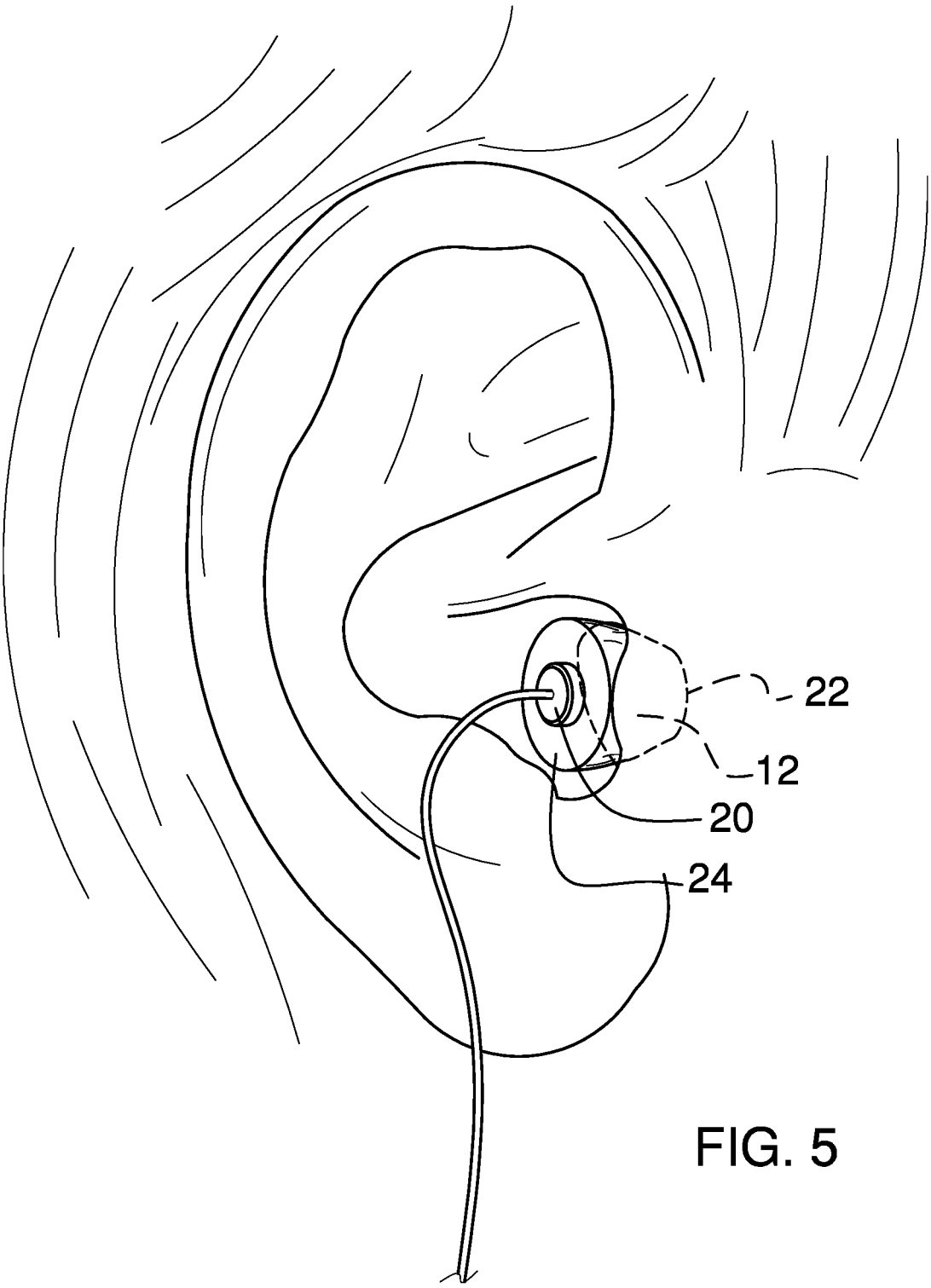
FIG. 5 is an in-use view of an embodiment of the disclosure.

The channel 18 may be circularly shaped when viewed longitudinally, as shown in FIG. 4, so that the channel 18 is complementary to a substantially tubularly shaped headphone 20. The channel 18 may be alternatively shaped, such as, but not limited to, rectangularly shaped, ovally shape, triangularly shaped, and the like. Generally, the channel 18 would be shaped complementarily to a longitudinal profile of the headphone 20 that is to be inserted into the channel 18.

In use, the cylinder 12 is compressed proximate to the leading end 22 and is at least partially inserted into the ear canal. The cylinder 12 then expands to couple the device to the ear within the ear canal, where it is positioned to attenuate the ambient noise and to direct the sound that is transmitted by the headphone 20 to the eardrum of the user.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the elements is present, unless the context clearly requires that there be only one of the elements.

I claim:

1. A headphone and ear tip device combination comprising:

the headphone, the headphone having a speaker, a base, and a medial portion extending between the speaker and the base, the medial portion being cylindrical, the base being disc-shaped and concentric with the medial portion, the base having a radius greater than a radius of the medial portion;

a cylinder, the cylinder comprising silicone and viscoelastic polyurethane foam such that the cylinder is resiliently compressible, the cylinder comprising a shell and a core, the shell defining an interior space, the core occupying the interior space, the core comprising viscoelastic polyurethane foam, the shell comprising silicone; and a channel axially positioned in and extending through the cylinder wherein the channel is configured for expanding for inserting the headphone onto the medial portion between the speaker and the base, the cylinder being compressible for contracting the cylinder towards the medial portion of the headphone wherein the cylinder is configured for compressing between digits of a hand of a user positioning the user for at least partially inserting the cylinder into an ear canal of the user such that the cylinder is positioned for expanding for conforming to the ear canal and for coupling the cylinder to the ear canal wherein the cylinder is configured for attenuating ambient noise and for directing a sound transmitted by the headphone to an eardrum of the user.

2. The device of claim 1, further including the channel being circularly shaped when viewed longitudinally such that the channel is complementary to the medial portion of the headphone.

3. A headphone and ear tip device combination comprising:

the headphone, the headphone having a speaker, a base, and a medial portion extending between the speaker and the base, the medial portion being cylindrical, the base being disc-shaped and concentric with the medial portion, the base having a radius greater than a radius of the medial portion;

a cylinder, the cylinder comprising silicone and viscoelastic polyurethane foam such that the cylinder is resiliently compressible, the cylinder comprising a shell and a core, the shell defining an interior space, the core occupying the interior space, the core comprising viscoelastic polyurethane foam, the shell comprising silicone; and a channel axially positioned in and extending through the cylinder wherein the channel is configured for expanding for inserting the headphone onto the medial portion between the speaker and the base, the cylinder being compressible for contracting the cylinder towards the medial portion of the headphone wherein the cylinder is configured for compressing between digits of a hand of a user positioning the user for at least partially inserting the cylinder into an ear canal of the user such that the cylinder is positioned for expanding for conforming to the ear canal and for coupling the cylinder to the ear canal wherein the cylinder is configured for attenuating ambient noise and for directing a sound transmitted by the headphone to an eardrum of the user, the channel being circularly shaped when viewed longitudinally such that the channel is complementary to a tubularly shaped headphone.

* * * * *